United States Patent [19]

Mika et al.

[11] 4,435,129

[45] Mar. 6, 1984

[54] VORTEX INJECTOR

[76] Inventors: Gyorgy Mika, 9/A, Szajko utca, 1021 Budapest; Dénes Csako, 6 Budakeszi ut, 1121 Budapest; Laszlo Paczuk, 93, Beke ut, 6131 Szank; Laszlo Beres-Deak, Tallya u. 8-10, 1121 Budapest; Laszlo Novotny, Bimbo u. 3, 1022 Budapest, all of Hungary

[21] Appl. No.: 304,634

[22] Filed: Sep. 22, 1981

Related U.S. Application Data

[63] Continuation-in-part of Ser. No. 22,046, Mar. 19, 1979, abandoned.

[51] Int. Cl.[3] ..... F04F 5/00

[52] U.S. Cl. ..... 417/151

[58] Field of Search ..... 417/171, 194, 197, 196, 417/151, 198, 179

[56] References Cited

U.S. PATENT DOCUMENTS

| | | | |
|---|---|---|---|
| 1,333,713 | 3/1920 | Hopkins | 417/151 |
| 2,044,088 | 6/1936 | Lord | 417/151 |
| 2,938,658 | 5/1960 | Foster | 417/171 |
| 3,739,576 | 6/1973 | Chamberlain | 417/171 X |
| 4,245,961 | 1/1981 | Bunting et al. | 417/171 |

FOREIGN PATENT DOCUMENTS

| | | | |
|---|---|---|---|
| 203139 | 12/1967 | U.S.S.R. | 417/171 |

*Primary Examiner*—Edward K. Look

*Attorney, Agent, or Firm*—Young & Thompson

[57] ABSTRACT

A vortex injector is made of cylindrical and partial cylindrical segments whose axes are offset from each other thereby to provide a simple and inexpensive construction. A high pressure inlet is disposed axially of a larger mixing pipe which in turn is eccentric to the casing. A low pressure inlet pipe is disposed tangentially of the casing and communicates with the mixing pipe downstream of the high pressure inlet. The intermediate pressure mixed gases enter the outlet casing eccentrically and are discharged therefrom tangentially.

8 Claims, 2 Drawing Figures

VORTEX INJECTOR

This application is a continuation-in-part of our copending application Ser. No. 22,046, filed Mar. 19, 1979, now abandoned.

The present invention relates to vortex injectors, more particularly of the type in which a high pressure gas and a low pressure gas are separately introduced into the injector and admixed and discharged therefrom at an intermediate pressure.

It is an object of the present invention to provide such an injector, which will be simple in construction and easy to fabricate from inexpensive parts.

Figure 1:
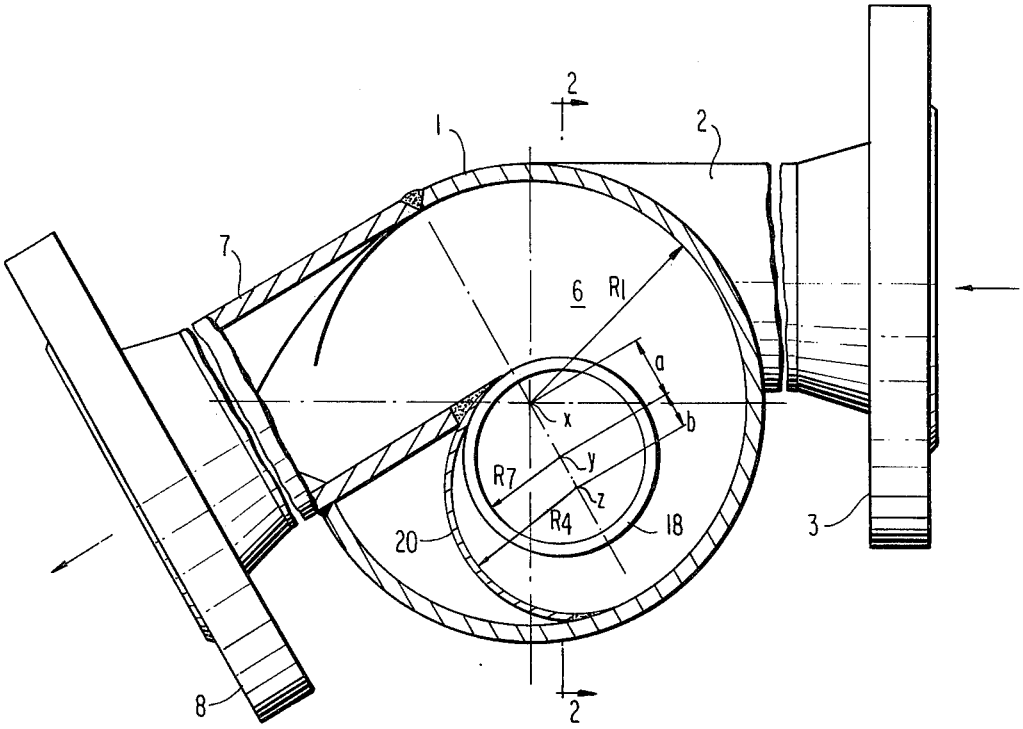
Figure 2:
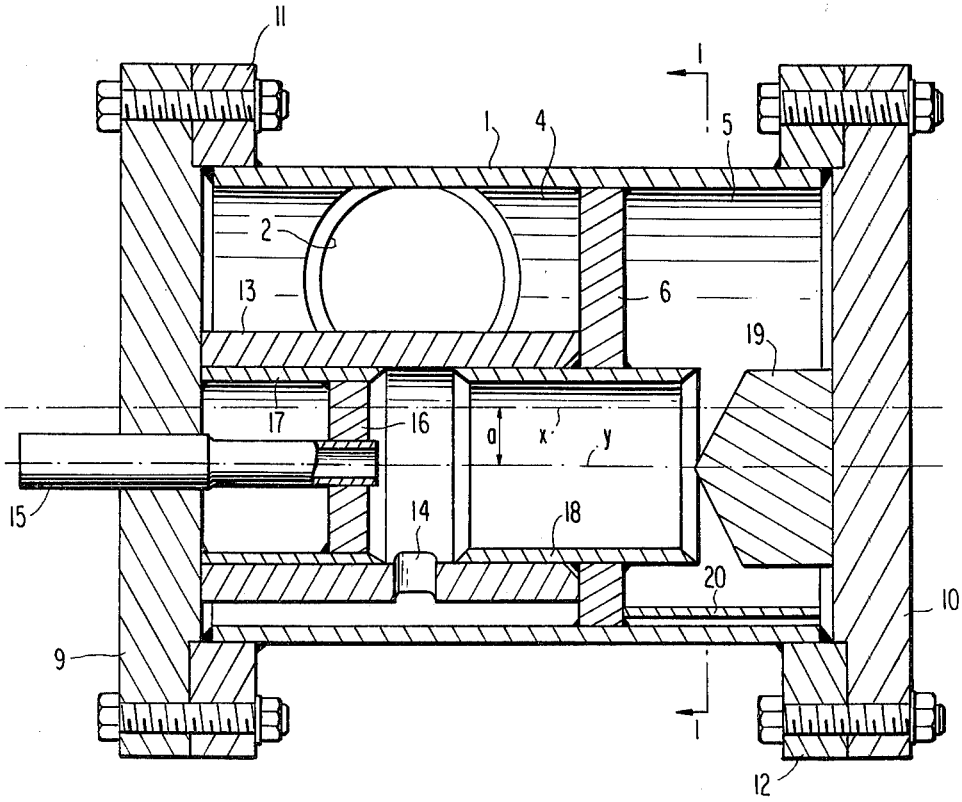

This and other objects and features of the present invention will become apparent from a consideration of the following description, taken in connection with the accompanying drawing, in which:

FIG. 1 is a cross-sectional view of a vortex injector according to the present invention, taken on the line 1—1 of FIG. 2; and FIG. 2 is a cross-sectional view thereof taken on the line 2—2 of FIG. 1.

Referring now to the drawing in greater detail, there is shown a vortex injector according to the present invention, characterized by a cylindrical casing 1 of sheet steel having a high pressure inlet pipe 2 opening tangentially thereinto. Pipe 2 is adapted to be connected by flange 3 to any desired pipeline (not shown).

The interior of casing 1 is divided into an inlet chamber 4 and an outlet chamber 5 by means of a transverse wall 6. An outlet conduit 7 discharges gas at intermediate pressure from outlet chamber 5. Conduit 7 may be attached to any pipeline (not shown) as desired, by means of a flange 8. The opposite ends of chambers 4 and 5 are closed by heads 9 and 10 detachably connected to respective flanges 11 and 12 on opposite ends of casing 1.

Eccentrically disposed within inlet chamber 4, is a pipe 13 that extends full length of chamber 4 and is secured at one end to wall 6 and abuts head 9 at its other end. Pipe 13 is traversed by an opening 14 for the passage of gas from inlet 2 into the interior of pipe 13.

A low pressure inlet pipe 15 passes through head 9 into chamber 4 eccentrically thereof and is held at its inner end by a partition 16 secured in a pipe 17 within pipe 13 to the left of opening 14 as seen in FIG. 2. To the right of opening 14 as seen in FIG. 2, a further pipe 18 extends between and protrudes into each of chambers 4 and 5 and is secured to wall 6 and to pipe 13. A cone 19, which serves as a diffuser, is secured to head 10 inside chamber 5 at the outlet of pipe 18. Pipes 13, 15, 17 and 18 and cone 19 are all coaxial about an axis displaced from the axis of casing 1 a distance a as seen in both figures of the drawing.

In outlet chamber 5, a semi-cylindrical plate 20 is provided, whose radius $R_4$ is only slightly more than half the radius $R_1$ of casing 1, but whose radius is substantially greater than the radius $R_7$ of pipe 18. Plate 20 is arranged as seen in FIG. 1, namely, as the inner convolute of the scroll which terminates in outlet pipe 7. Thus, plate 20 is tangential at one side with the pipe 7 and at its other side with the casing 1.

The axes of pipe 18 and plate 20 are spaced apart a distance b as seen in FIG. 2. As is also seen in that figure, the axis x of casing 1, the axis y of pipe 18, and the axis z of plate 20 are disposed in that order proceeding radially outwardly from axis x, and lie in a common plane which also intersects the points of tangency of plate 20 and the points of tangency of pipe 7 with casing 1 and pipe 18 and plate 20.

The operation of the device will thus be clear: gas at high pressure enters inlet 2 and traverses opening 14 and inducts gas at low pressure through pipe 15, the mixed gases then passing through pipe 18 and being diffused by cone 19, after which they move with vortical motion along the scroll provided by plate 20 and 180 degrees of the outside of casing 1, to outlet pipe 7 at intermediate pressure.

It will thus be appreciated that a simple construction has been provided, in which standard cylindrical pipes and casings can be used, with a minimum of expense of preparation and fabrication and hence with a lowest cost of the completed vortex injector.

In view of the foregoing disclosure, therefore, it will be evident that the initially recited object of the present invention has been achieved.

Although the present invention has been described and illustrated in connection with a preferred embodiment, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. A vortex injector comprising a cylindrical casing, means for introducing a high pressure gas into the cylindrical casing, means for introducing a low pressure gas into the casing parallel but eccentrically to the axis of the casing, means for mixing together the low and high pressure gases, means for discharging from the casing the mixed low and high pressure gases at an intermediate pressure, said discharge means being disposed tangentially of the casing, and a partially cylindrical plate forming with said discharge means a helical scroll for gases leaving said chamber.

2. A vortex injector as claimed in claim 1, said means for introducing said high pressure gas being disposed tangentially of the casing.

3. A vortex injector as claimed in claim 1, said means for mixing together said low and high pressure gases comprising a cylindrical pipe disposed with its axis parallel to the axis of the casing but eccentrically offset from the axis of the casing.

4. Apparatus as claimed in claim 3, and a conical deflector disposed in said casing coaxially of said pipe.

5. Apparatus as claimed in claim 3, and a wall subdividing said casing into an inlet chamber and an outlet chamber, said pipe extending on both sides of said wall.

6. A vortex injector as claimed in claim 1, said plate being tangential with said casing and the radially inner side of said outlet means.

7. A vortex injector as claimed in claim 6, said means for mixing together said low and high pressure gases comprising a cylindrical pipe disposed with its axis parallel to the axis of the casing but eccentrically offset from the axis of the casing, the axes of said casing and pipe and plate being disposed in a common plane that extends radially of said casing.

8. A vortex injector as claimed in claim 7, said discharge means being tangential with said pipe, the points of tangency of said discharge means with said casing and with said pipe lying also in said common plane.

* * * * *